US008113774B2

(12) United States Patent
Yang et al.

(10) Patent No.: US 8,113,774 B2
(45) Date of Patent: Feb. 14, 2012

(54) FAN FRAME AND HEAT DISSIPATION FAN INCORPORATING THE FAN FRAME

(75) Inventors: Zhi-Ya Yang, Shenzhen (CN); Wen-Gao Wang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 889 days.

(21) Appl. No.: 12/168,910

(22) Filed: Jul. 8, 2008

(65) Prior Publication Data

US 2009/0246016 A1 Oct. 1, 2009

(30) Foreign Application Priority Data

Mar. 26, 2008 (CN) ..... 2008 1 0066340

(51) Int. Cl.
*F01D 25/26* (2006.01)
*F01D 25/28* (2006.01)

(52) U.S. Cl. ..... 415/213.1

(58) Field of Classification Search ..... 415/213.1
See application file for complete search history.

(56) References Cited

U.S. PATENT DOCUMENTS 6,073,305 A * 6/2000 Hesskamp ..... 15/405
6,926,497 B2 * 8/2005 Lin et al. ..... 415/213.1
7,140,837 B2 * 11/2006 Ku et al. ..... 415/121.2

FOREIGN PATENT DOCUMENTS

CN 2695698 Y 4/2005

* cited by examiner

*Primary Examiner* — Jarrett Stark
*Assistant Examiner* — Nicholas Tobergte
(74) *Attorney, Agent, or Firm* — Altis Law Group, Inc.

(57) ABSTRACT

A fan frame (20) includes a bracket (22) and a base (24). The bracket includes a sidewall (225). An air inlet (228) is defined in a top side of the sidewall. An opposite air outlet (229) is defined in a bottom side of the sidewall. A plurality of first locking units (227) are formed on the sidewall. The base includes a main body (240), a plurality of ribs (242) and a plurality of second locking units (245). Each rib has a fixed end (2421) connected with the main body, and an opposite free end (2422). Each second locking unit is formed at the free end of a corresponding rib. The second locking units are detachably interlocked with the first locking units to mount the base to the bracket thereby to form the fan frame. The bracket and base are formed by materials having different strengths.

16 Claims, 8 Drawing Sheets

FAN FRAME AND HEAT DISSIPATION FAN INCORPORATING THE FAN FRAME

BACKGROUND

1. Technical Field

The present invention relates to fan frames, and more particularly to a new and improved fan frame for use in connection with a heat dissipation fan which typically intends for dissipating heat from electronic components.

2. Description of Related Art

A typical heat dissipation fan generally comprises a fan frame, and a stator and a rotor received in the fan frame. The fan frame incorporated in the heat dissipation fan generally includes a bracket, a central tube and a plurality of ribs. The central tube locates in a center of the bracket for installing the rotor and the stator thereon. The ribs interconnect the central tube with the bracket for fastening the central tube in place. The bracket, the central tube and the ribs are integrally molded to form the fan frame.

However, such integrally molded structure of the fan frame has many disadvantages. As the fan develops, some parts of the fan frame of the fan need special features to meet special requirements; for example, the central tube and the ribs require a high strength while the bracket does not. However, because the bracket, the central tube and the ribs are integrally molded, the fan frame needs to be wholly molded by a material having a high strength to satisfy the special requirement of the central tube and the ribs. This results in a high cost of the fan frame. When some parts of the fan frame are damaged and need to be replaced, the whole fan frame must be replaced due to the integrity of the fan frame, which results in a high maintenance cost for the fan incorporating the fan frame. Additionally, a fan which incorporates a fan frame having a large air inlet can produce a large amount of airflow, and a fan which incorporates a fan frame having a small air outlet can produce a high air pressure. However, when there is a requirement to replace a fan with a large amount of airflow with a fan with a high air pressure or vice versa, the original fan must be totally discarded; this also increases the cost.

What is needed, therefore, is a new fan frame of a heat dissipation fan which can overcome the above-mentioned disadvantages.

SUMMARY

The present invention relates to a fan frame. According to an exemplary embodiment of the present invention, the fan frame includes a bracket and a base. The bracket includes a sidewall, an air inlet defined in a top side of the sidewall and an opposite air outlet defined in a bottom side of the sidewall. The sidewall defines a plurality of first locking units thereon. The base includes a main body, a plurality of ribs and a plurality of second locking units. Each rib has a fixed end connected with the main body and an opposite free end. Each second locking unit is formed at the free end of a corresponding rib. The second locking units are detachably interlocked with the first locking units to mount the base to the bracket to thereby form the fan frame. The base and the bracket are made of different materials, wherein the material for forming the base has a strength higher than that for forming the bracket.

The present invention relates, in another aspect, to a heat dissipation fan. According to an embodiment of the present invention, the heat dissipation fan includes a fan frame, a stator a stator mounted to the base and received in the fan frame and a rotor rotatable with respect to the stator. The fan frame includes a bracket and a base. The bracket includes a sidewall, an air inlet defined in a top side of the sidewall and an opposite air outlet defined in a bottom side of the sidewall. The sidewall defines a plurality of first locking units thereon. The base includes a main body, a plurality of ribs and a plurality of second locking units. Each rib has a fixed end connected with the main body and an opposite free end. Each respective second locking unit is formed at the free end of each respective rib. The second locking units are detachably interlocked with the first locking units to mount the base to the bracket.

Other advantages and novel features of the present invention will become more apparent from the following detailed description of embodiment when taken in conjunction with the accompanying drawings.

DETAILED DESCRIPTION OF THE EMBODIMENTS

Reference will now be made to the drawings to describe the various present embodiments in detail.

Figure 1:
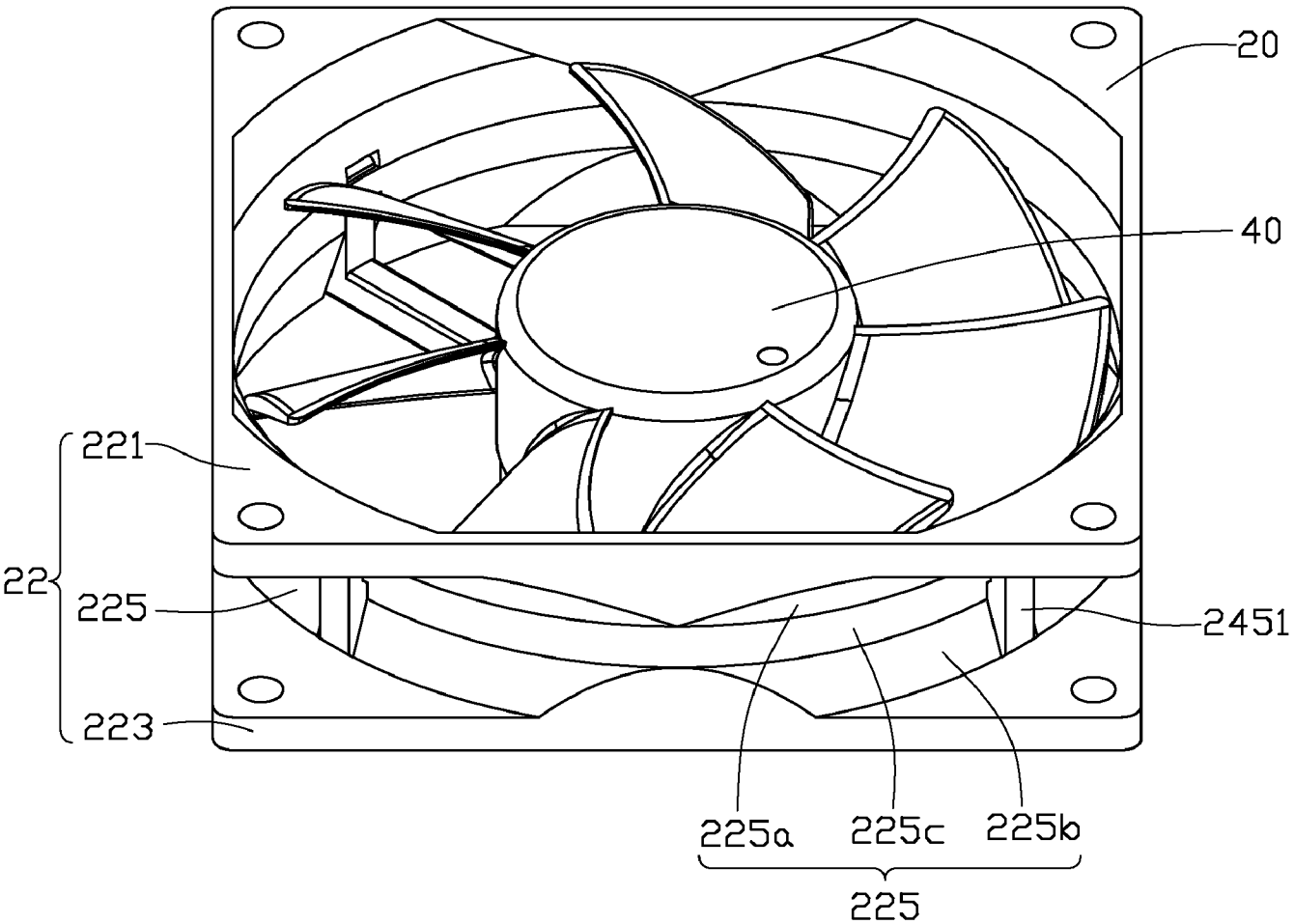
FIG. 1 an assembled, isometric view showing a heat dissipation fan in accordance with a first exemplary embodiment of the present invention.
Figure 2:
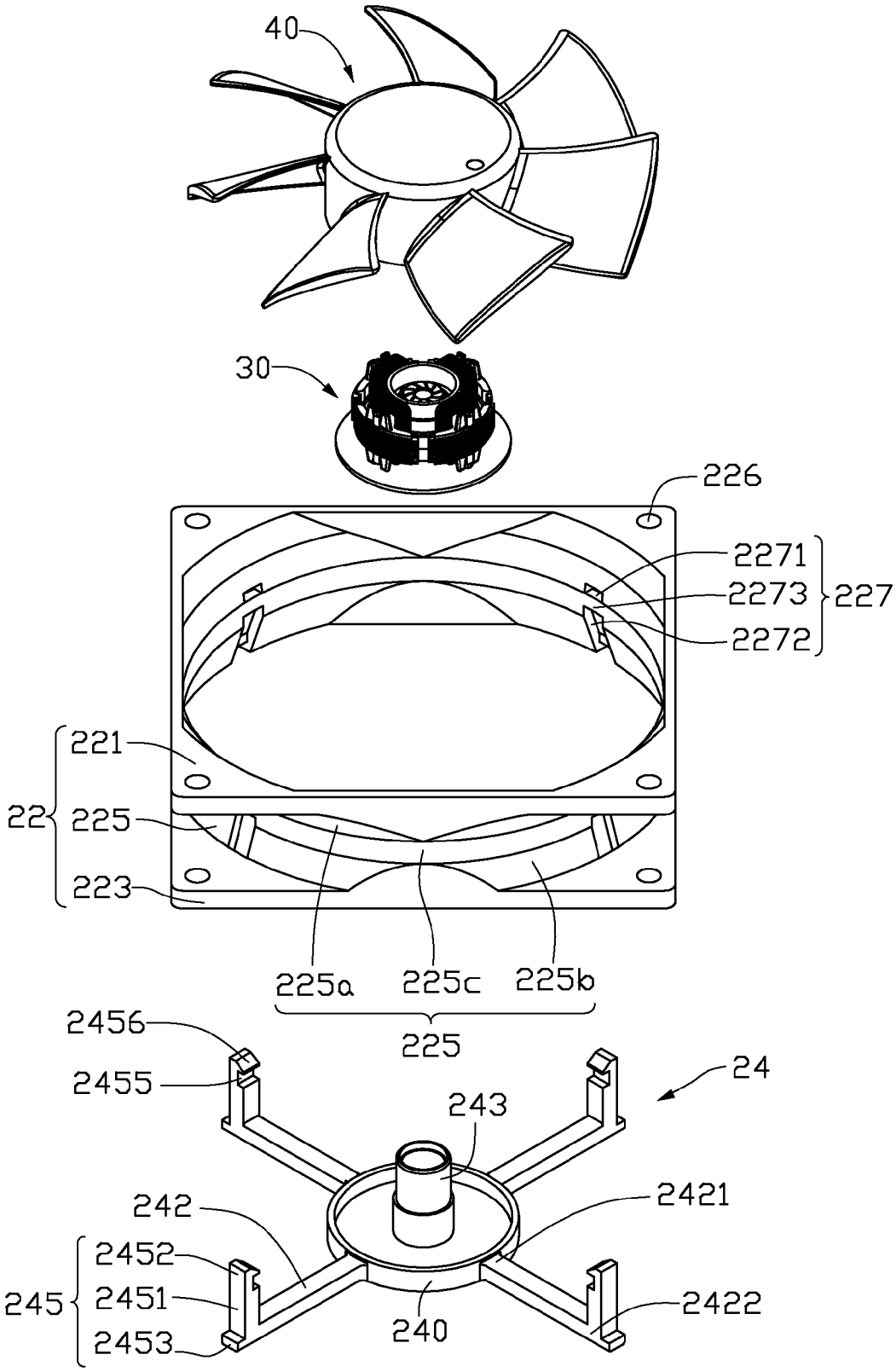
FIG. 2 is an exploded, isometric view of the heat dissipation fan of FIG. 1.

Referring to FIG. 1 and FIG. 2, a heat dissipation fan according to an exemplary embodiment includes a rotor 40, a stator 30 in respective to which the rotor 40 is rotatable, and a fan frame 20 receiving the rotor 40 and the stator 30 therein.

The fan frame 20 comprises a rectangular bracket 22 and a base 24 detachably mounted on a bottom side of the bracket 22.

Figure 3:
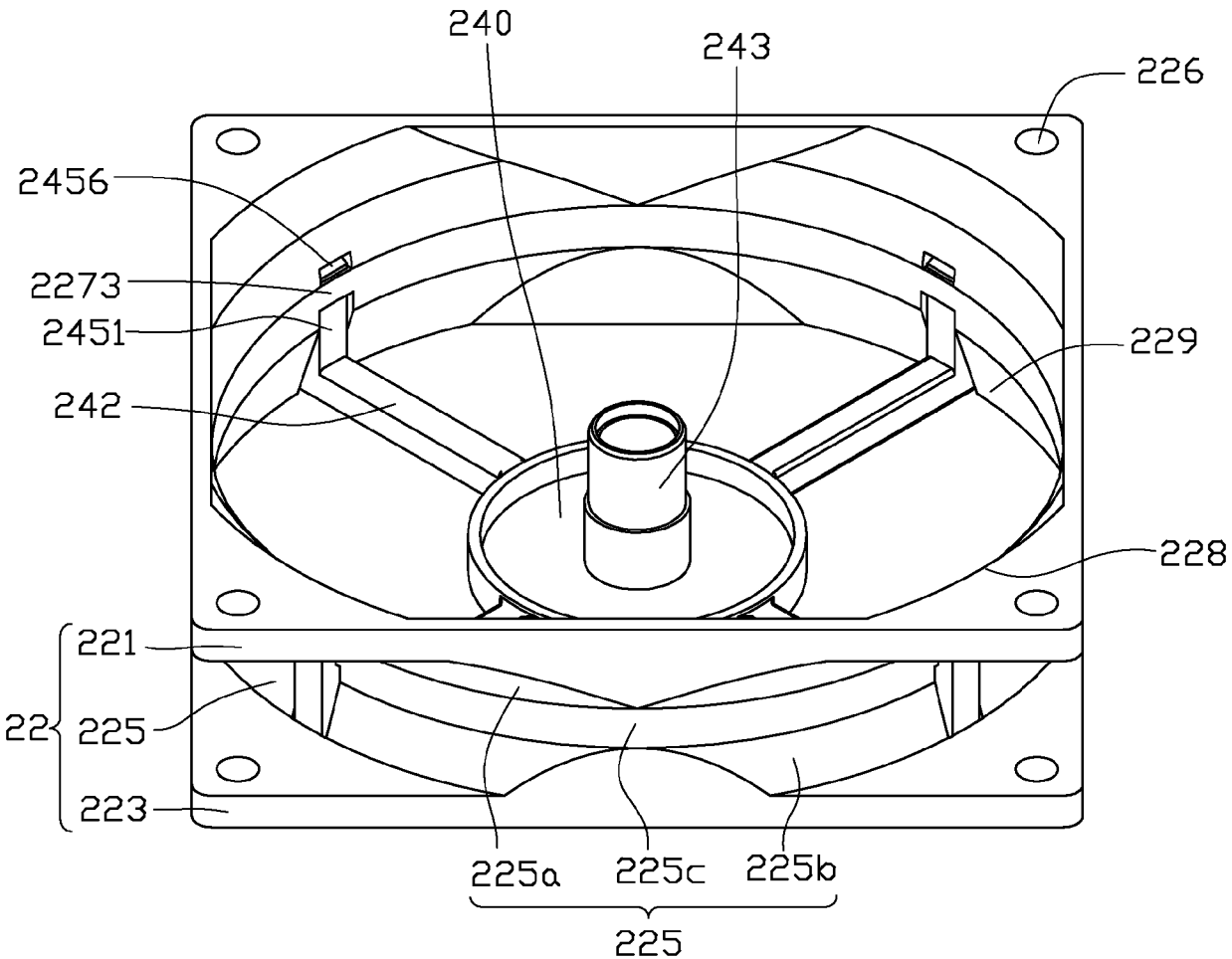
FIG. 3 is an isometric view of a fan frame of the heat dissipation fan of FIG. 1.
Figure 4:
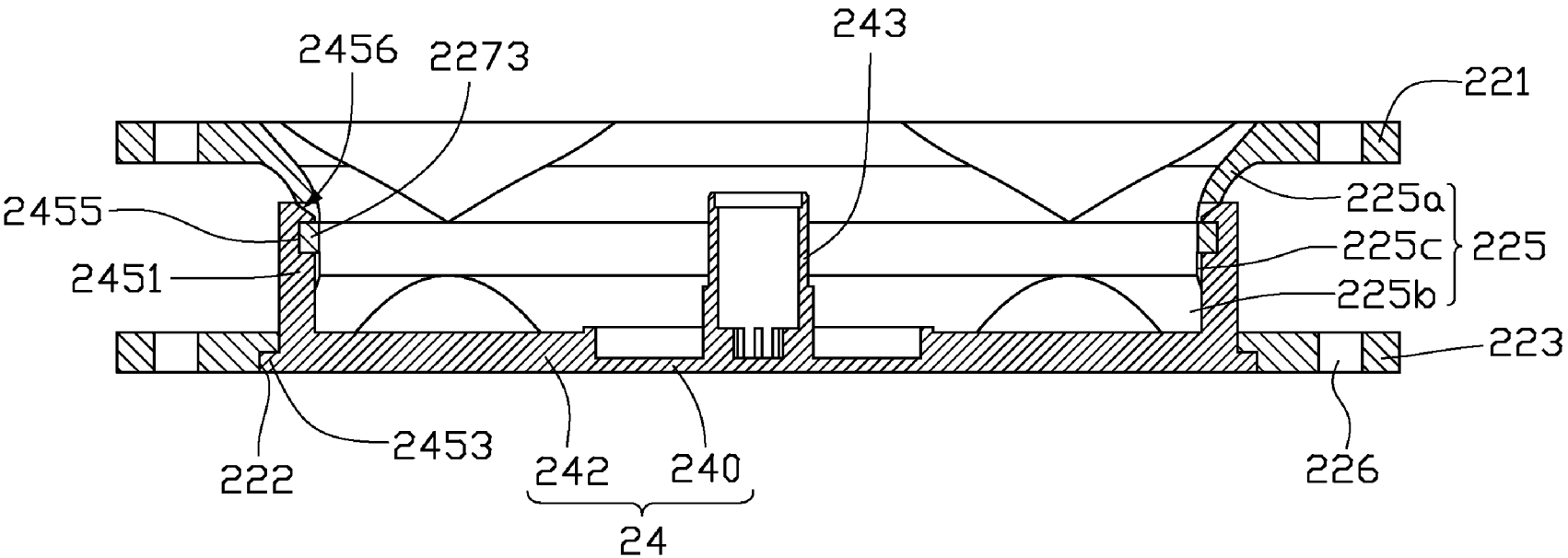
FIG. 4 is a cross-section view of the fan frame of FIG. 3.

Referring to FIG. 3, the bracket 22 comprises a top plate 221, an opposite bottom plate 223 and a sidewall 225 interconnecting the top plate 221 with the bottom plate 223. The top plate 221 extends horizontally outwardly from a top end of the sidewall 223. The bottom plate 223 extends horizontally outwardly from a bottom end of the sidewall 223. The bracket 22 is molded by plastic material, and includes an air inlet 228 and an air outlet 229. The air inlet 228 and the air outlet 229 are located at opposite sides of the bracket 22, wherein the air inlet 228 is defined in a central portion of the top plate 221, and the air outlet 229 is defined in a central portion of the bottom plate 223. Four mounting holes 226 are defined in four corners of the top plate 221 and four corners of the bottom plate 223 respectively. The sidewall 225 interconnects an inner periphery of the top plate 221 and an inner periphery of the bottom plate 223. The sidewall 225 includes a top portion 225*a*, a bottom portion 225*b* and a middle portion 225*c* interconnecting the top portion 225*a* with the bottom portion 225*b*. The top portion 225*a* and the bottom portion 225*b* of the sidewall 225 each have an inner diameter larger than an inner diameter of the middle portion 225*c* of the sidewall 225. Four first locking units 227 are formed on the sidewall 225 near the four corners of the top plate 221 and the bottom plate 223 respectively. Each of the first locking units 227 comprises a block 2273 formed on the middle portion 225*c* of the sidewall 225, a first hole 2271 defined on the top portion 225*a* of the sidewall 225 and a second hole 2272 defined on the bottom portion 225*b* of the sidewall 225. As shown in FIG. 4, a plurality of recesses 222 are defined in a bottom surface of the bottom plate 223 and surround the air outlet 229. Each of the recesses 222 communicates with a corresponding second hole 2272 of the first locking unit 227.

Referring back to FIG. 2, in the present embodiment, the base 24 is formed from a different material based on the designed strength requirement, such as metal or fiber-reinforced plastic. The material for forming the base 24 has a strength higher than that for forming the bracket 22. The base 24 comprises a circular main body 240, a central tube 243 extending upwardly from a top surface of the main body 240 and a plurality of ribs 242 extending outwardly from a periphery of the main body 240. Each of the ribs 242 has a fixed end 2421 connected with the main body 240, and an opposite free end 2422. A plurality of second locking units 245 are formed on the free ends 2422 of the ribs 242 in one-to-one manner. Each of the second locking units 245 comprises a pole 2451, a hook 2452 and a nub 2453. The pole 2451 extends upwardly and perpendicularly from the free end 2422 of the corresponding rib 242. Each of the poles 2451 has a size substantially equals to a size of the second hole 2272 of the first locking unit 227. Each of the hooks 2452 extends inwardly from a top end of the pole 2451 towards the central tube 243. An inclined guiding surface 2456 is formed on a top surface of the hook 2452. A receiving trough 2455 is formed on an inner side surface of the pole 2451 immediately below the hook 2452 and faces to the central tube 243. The receiving trough 2455 is configured for receiving a corresponding block 2273 of the first locking unit 227 therein. Each of the nubs 2453 extends outwardly and horizontally from the free end 2422 of the corresponding rib 242. The nub 2453 has a shape and a size substantially similar to the shape and the size of the recess 222 of the bottom plate 223 of the bracket 22.

Referring also to FIG. 4, in assembly, the base 24 is placed at a bottom side of the bracket 22 with the second locking units 245 of the base 24 aligned with the first locking units 227 of the bracket 22. The base 24 is pressed towards the bracket 22 until the poles 2451 extend through the second holes 2272 of the first locking units 227 and the hooks 2452 engage in the first holes 2271 of the first locking units 22. Meanwhile, each nub 2453 is received in the corresponding recess 222 and abuts against the bottom plate 223 of the bracket 22. Finally, the stator 30 is mounted around the central tube 243, and the rotor 40 is rotatably disposed around the stator 30. A shaft (not shown) of the rotor 40 extends downwardly through a bearing (not shown) which has been mounted in the central tube 243 beforehand.

In assembly of the present fan frame 20, each hook 2452 of the second locking unit 245 of the base 24 firstly is elastically deformed by the corresponding block 2273 of the first locking unit 227 when traveling from the second hole 2272 towards the first hole 2271, and then returns to its original state to protrude inwardly in the first hole 2271 after traveling through the corresponding block 2273. The corresponding block 2273 is engaged in the receiving trough 2455 formed adjacent to a bottom of the hook 2452, thereby securely mounting the base 24 to the bracket 22.

In the present embodiment, the fan frame 20 is comprised of two parts, i.e., the bracket 22 and the base 24. When one part of the fan frame 20 is damaged and needs to be replaced or repaired, the hooks 2452 of the second locking units 245 of the base 24 are caused to disengage from the first holes 2271 of the first locking units 227. Then, the base 24 is dismounted from the bracket 22. Therefore, the base 24 is separated from the bracket 22. The damaged bracket 22 or base 24 can be replaced by another new bracket 22 or base 24. Furthermore, according to the requirement, the base 24 can be assembled with another bracket 22 having a larger air inlet to form a new fan frame in order to increase the amount of airflow of the heat dissipation fan incorporating the fan frame. Alternatively, the base 22 can be assembled to another bracket 22 having a smaller air outlet to form another fan frame in order to increase the air pressure of the heat dissipation fan incorporating the fan frame.

Figure 5:
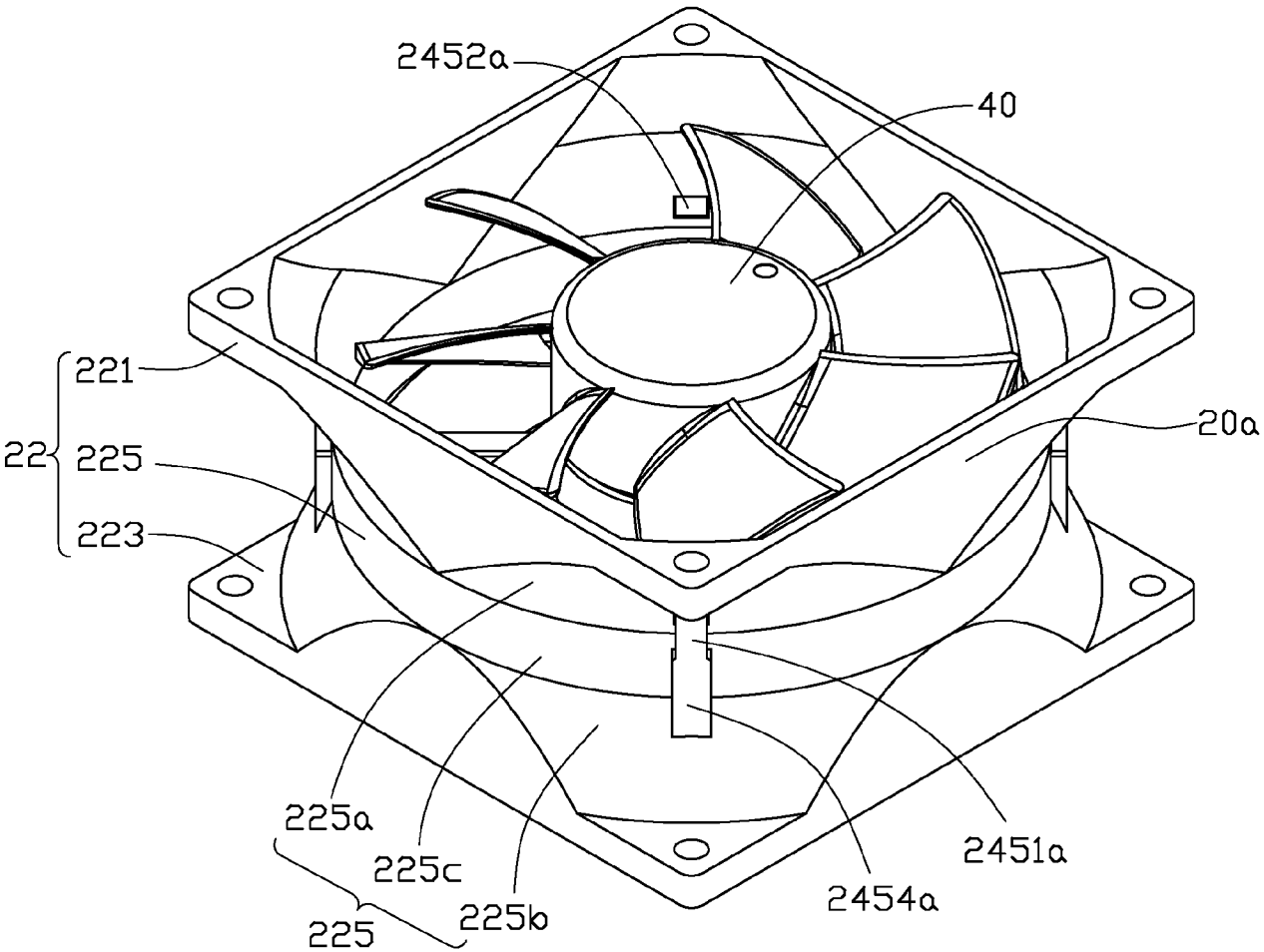
FIG. 5 is an assembled, isometric view showing a heat dissipation fan in accordance with a second exemplary embodiment of the present invention.
Figure 6:
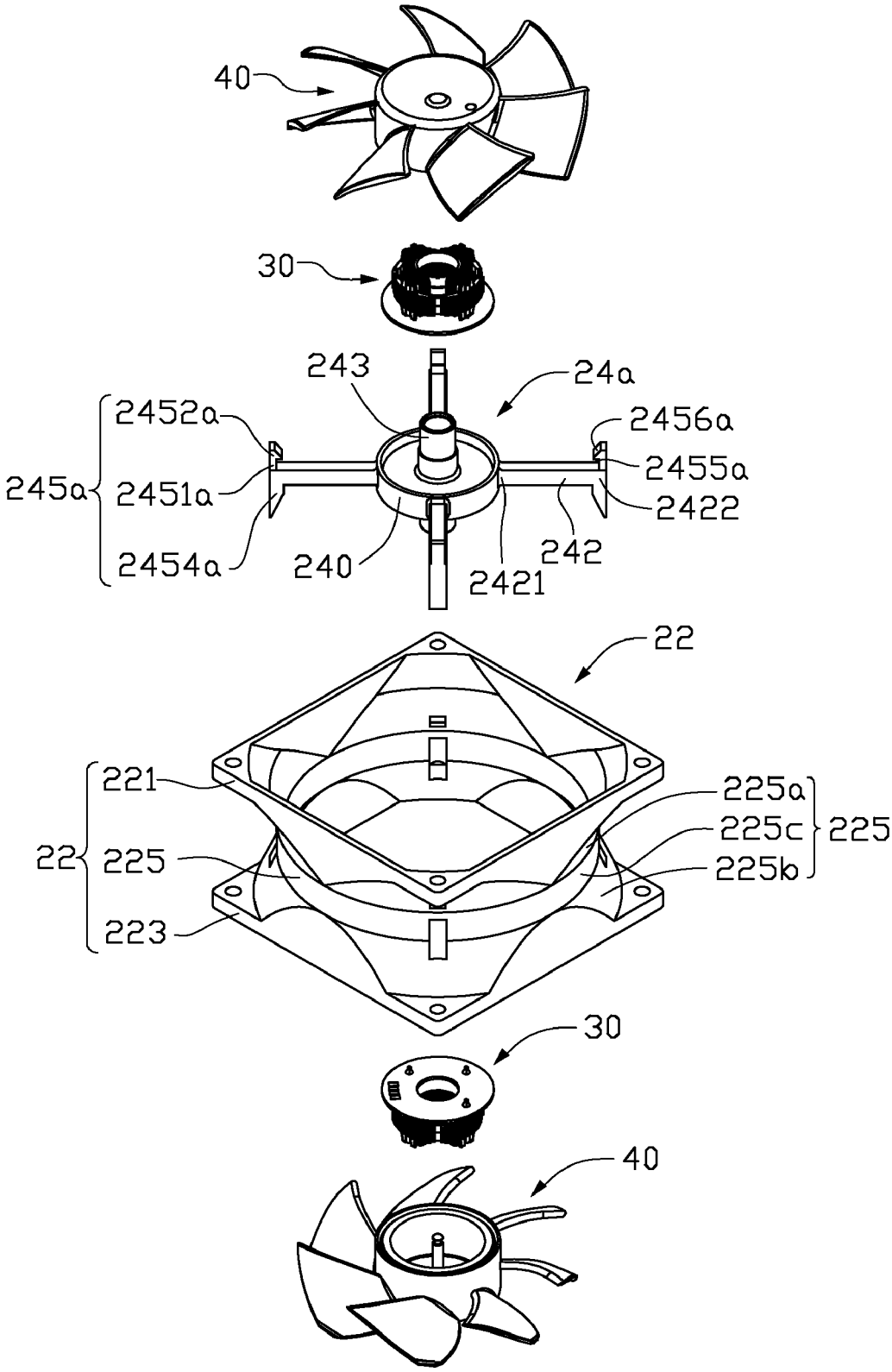
FIG. 6 is an exploded, isometric view of the heat dissipation fan of FIG. 5.

FIG. 5 and FIG. 6 show a heat dissipation fan according to a second embodiment. The heat dissipation fan comprises a fan frame 20*a*, and two stators 30 and two rotors 40 received in the fan frame 20*a*. The stators 30 and the rotors 40 are arranged symmetrically at top side and bottom side of the fan frame 20*a*, respectively. Each of the stators 30 and each of the rotors 40 have substantially the same configurations as the stator 30 and the rotor 40 of the previous first embodiment.

The fan frame 20*a* comprises a bracket 22 and a base 24*a* detachably mounted on a waist position of the bracket 22.

Figure 7:
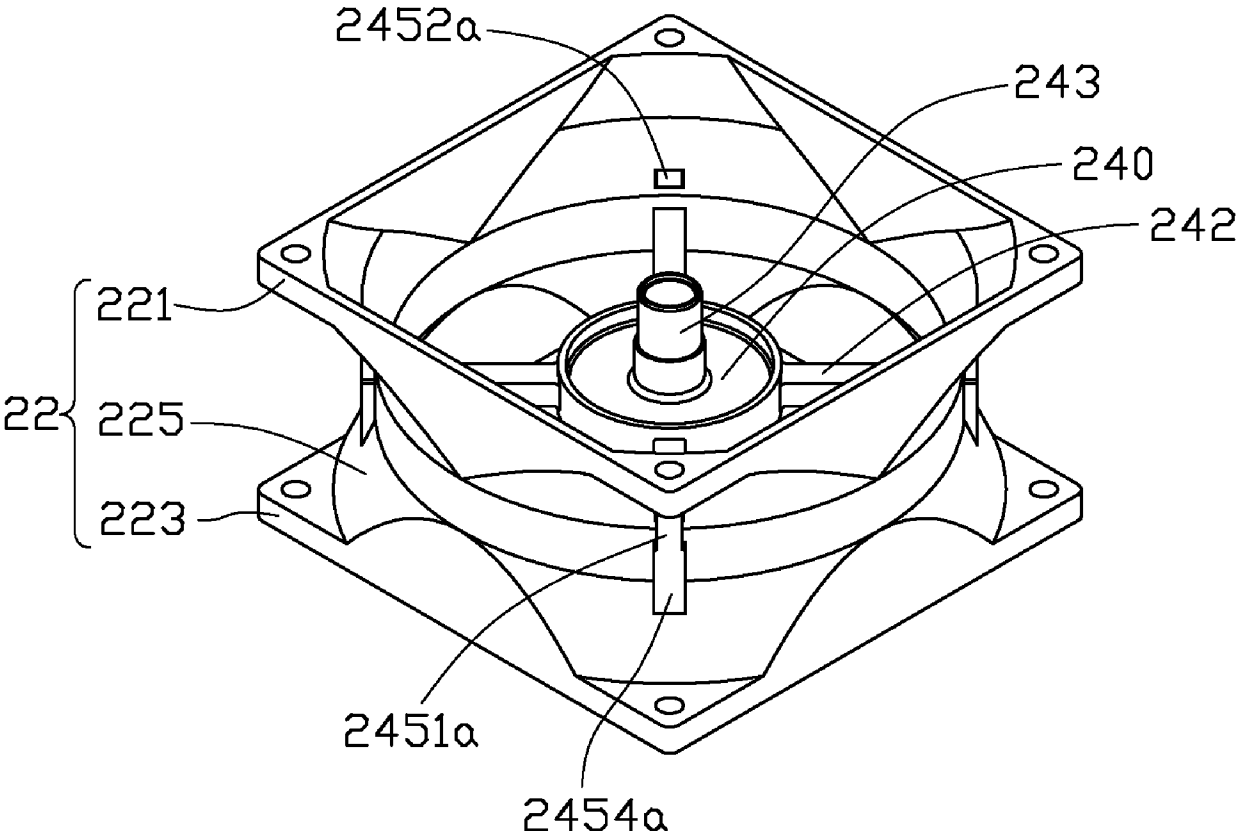
FIG. 7 is an isometric view of a fan frame of the heat dissipation fan of FIG. 5.
Figure 8:
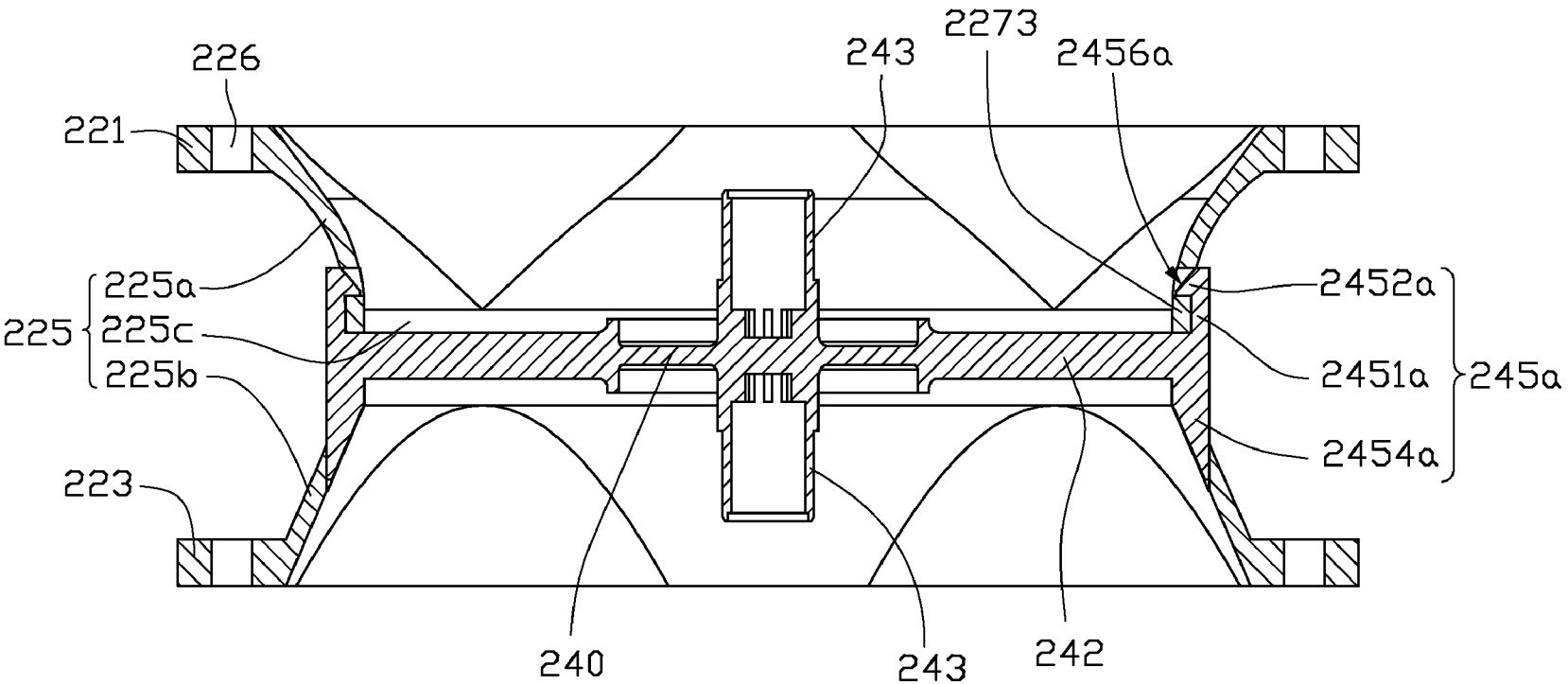
FIG. 8 is a cross-section view of the fan frame of FIG. 7.

Referring also to FIG. 7 and FIG. 8, the bracket 22 comprises a top plate 221, a bottom plate 223 and a sidewall 225 interconnecting the top plate 221 with the bottom plate 223. The sidewall 225 has a higher height than the sidewall 225 of the first embodiment. A plurality of first locking units 227 are formed on the sidewall 225 of the bracket 22. As similar to the first embodiment, each of the first locking units 227 comprises a block 2273, and a first hole 2271 and a second hole 2272 defined on a top side and a bottom side of the block 2273 respectively. The block 2273 is located at a position above the middle portion 225*c* of the sidewall 225.

The base 24*a* comprises a circular main body 240, two central tubes 243 extending oppositely from a top surface and a bottom surface of the main body 243 respectively, and a plurality of ribs 242 extending outwardly from a periphery of the main body 240. Each of the ribs 242 comprises a fixed end 2421 connected with the main body 240, and an opposite free end 2422. A plurality of second locking units 245*a* are formed on the free ends 2422 of the ribs 242 respectively. Each of the second locking units 245*a* comprises a pole 2451*a* extending upwardly and perpendicularly from the free end 2422 of the rib 242, a hook 2452*a* extending inwardly from a top end of the pole 2451*a*, and a fixing post 2454*a* extending downwardly and perpendicularly from the free end 2422 of the rib 242. A receiving trough 2455*a* is formed on an inner side surface of the pole 2451 and faces to the central tube 243. The receiving trough 2455 is located just under the hook 2452*a*, and is configured for receiving a corresponding block 2273 of the first locking unit 227 therein.

During assembly, the base 24*a* is placed at a bottom side of the bracket 22 with the second locking units 245*a* of the base 24*a* pointing to the first locking units 227 of the bracket 22. The base 24*a* is pressed towards the bracket 22 until the poles 2451*a* extend through the second holes 2272 of the first locking units 227 and the hooks 2452*a* engage in the first holes 2271 of the first locking units 227. The blocks 2273 of the first locking units 227 engage in the receiving troughs 2455*a* of the second locking units 245*a*. Simultaneously, each post 2454*a* is received in the second hole 2272 of the corresponding first locking unit 227 and abuts against the bottom portion 225*b* of the sidewall 225 of the bracket 22. The base 24*a* is securely mounted to the bracket 22 through the first locking units 227 and the second locking units 245*a* interlocked together. Each of the central tube 243 is assembled with a stator 30 and a rotor 40 around an outer periphery thereof.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan frame comprising:

a bracket comprising a sidewall, an air inlet defined in a top side of the sidewall and an opposite air outlet defined in a bottom side of the sidewall, the sidewall defining a plurality of first locking units thereon; and a base comprising a main body, a plurality of ribs and a plurality of second locking units, each rib having a fixed end connected with the main body and an opposite free end, each second locking unit being formed at the free end of a corresponding rib, the second locking units being detachably interlocked with the first locking units to mount the base to the bracket to form the fan frame;

wherein each of the first locking units comprises a block, a first hole located at a top side of the block and a second hole located at a bottom side of the block, each of the second locking units comprising a hook, the hook engaged with the block and protruded inwardly in the first hole of the each of the first locking units; and wherein each of the second locking units further comprises a pole interconnecting the hook with the each rib, the pole extending upwardly from the free end of the each rib and traveling through the second hole into the first hole of the each of the first locking units.

2. The fan frame of claim 1, wherein the base is mounted at the bottom side of the bracket, and a central tube extends upwardly from a top surface of the main body.

3. The fan frame of claim 1, wherein the base is mounted at a waist position of the bracket, and two central tubes extend oppositely from a top surface and a bottom surface of the main body respectively.

4. The fan frame of claim 3, wherein each of the second locking units further comprises a fixing post, the fixing post extending downwardly from the free end of the each rib and received in the second hole of the each of the first locking units.

5. The fan frame of claim 1, wherein a plurality of recesses are defined in a bottom surface of the bracket, each of the second locking units further comprising a nub, the nub extending outwardly from the free end of the each rib and being received in a corresponding recess of the bracket.

6. The fan frame of claim 1, wherein the hook forms an inclined guiding surface on a top surface thereof.

7. A heat dissipation fan comprising:

a fan frame comprising a bracket and a base, the bracket comprising a sidewall, an air inlet defined in a top side of the sidewall and an opposite air outlet defined in a bottom side of the sidewall, the sidewall defining a plurality of first locking units thereon, the base comprising a main body, a plurality of ribs and a plurality of second locking units, each rib having a fixed end connected with the main body and an opposite free end, each second locking unit being formed at the free end of a corresponding rib, the second locking units being detachably interlocked with the first locking units to mount the base to the bracket to thereby form the fan frame;

a stator mounted to the base and received in the fan frame; and a rotor rotatable with respect to the stator;

wherein each of the first locking units comprises a block, and each of the second locking units comprises a hook for engaging with the block of the each of the first locking units; and wherein each of the second locking units further comprises a pole connecting the hook with the free end of the each rib, each of the first locking units further comprising a first hole located at a top side of the block and a second hole located at a bottom side of the block, the hook engaged with the block and protruded inwardly in the first hole of the each of the first locking units, the pole extending upwardly from the free end of the each rib and traveling through the second hole into the first hole of the each of the first locking units.

8. The heat dissipation fan of claim 7, wherein a plurality of recesses are defined in a bottom surface of the bracket, each of the second locking units further comprising a nub, the nub extending outwardly from the free end of the each rib and being received in a corresponding recess of the bracket.

9. The heat dissipation fan of claim 7, wherein the base is mounted in a waist position of the bracket, two central tubes extending oppositely from a top surface and a bottom surface of the main body respectively, the stator and the rotor mounted around one of the central tube, the heat dissipation fan further comprising another stator and another rotor mounted around the other one of the central tube.

10. The heat dissipation fan of claim 9, wherein each of the second locking units further comprises a fixing post, each of the first locking units further comprising a first hole located at a top side of the block and a second hole located at a bottom side of the block, the hook engaged with the block and protruded inwardly in the first hole of the each of the first locking units, the fixing post extending downwardly from the free end of the each rib and received in the second hole of the each of the first locking units.

11. The heat dissipation fan of claim 7, wherein material for forming the base has a strength which is higher than that for forming the bracket.

12. A fan frame comprising:

a bracket comprising a sidewall, an air inlet defined in a top side of the sidewall and an opposite air outlet defined in a bottom side of the sidewall, the sidewall defining a plurality of first locking units thereon; and a base comprising a main body, a plurality of ribs and a plurality of second locking units, each rib having a fixed end connected with the main body and an opposite free end, each second locking unit being formed at the free end of a corresponding rib, the second locking units being detachably interlocked with the first locking units to mount the base to the bracket to form the fan frame;

wherein each of the first locking units comprises a block, a first hole located at a top side of the block and a second hole located at a bottom side of the block, each of the second locking units comprising a hook, the hook engaged with the block and protruded inwardly in the first hole of the each of the first locking units; and wherein the hook forms an inclined guiding surface on a top surface thereof.

13. The fan frame of claim 12, wherein the base is mounted at the bottom side of the bracket, and a central tube extends upwardly from a top surface of the main body.

14. The fan frame of claim 12, wherein the base is mounted at a waist position of the bracket, and two central tubes extend oppositely from a top surface and a bottom surface of the main body respectively.

15. The fan frame of claim 14, wherein each of the second locking units further comprises a fixing post, the fixing post extending downwardly from the free end of the each rib and received in the second hole of the each of the first locking units.

16. The fan frame of claim 12, wherein a plurality of recesses are defined in a bottom surface of the bracket, each of the second locking units further comprising a nub, the nub extending outwardly from the free end of the each rib and being received in a corresponding recess of the bracket.

* * * * *